US011803137B2

(12) United States Patent
Hasegawa et al.

(10) Patent No.: US 11,803,137 B2
(45) Date of Patent: Oct. 31, 2023

(54) FIXING DEVICE SUPPRESSING SHAPE CHANGE OF ROLLER

(71) Applicant: FUJIFILM Business Innovation Corp., Tokyo (JP)

(72) Inventors: Makoto Hasegawa, Kanagawa (JP); Yasutaka Naito, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/828,019

(22) Filed: May 30, 2022

(65) Prior Publication Data

US 2023/0176507 A1 Jun. 8, 2023

(30) Foreign Application Priority Data

Dec. 3, 2021 (JP) ..... 2021-197147

(51) Int. Cl.
*G03G 15/20* (2006.01)
*G03G 21/20* (2006.01)

(52) U.S. Cl.
CPC ..... *G03G 15/2017* (2013.01); *G03G 15/2042* (2013.01); *G03G 21/206* (2013.01); *G03G 15/2053* (2013.01); *G03G 2215/2061* (2013.01)

(58) Field of Classification Search
CPC ..... G03G 15/2017; G03G 15/2042; G03G 15/2046; G03G 21/206; G03G 2215/2058; G03G 2215/2061; G03G 2221/1645; H05B 3/0066; H05B 3/0095
USPC ..... 399/92, 69, 334; 219/216
See application file for complete search history.

(56) References Cited

U.S. PATENT DOCUMENTS 5,787,321 A * 7/1998 Nishikawa ..... G03G 15/2042 399/92
2013/0223865 A1* 8/2013 Nakamura ..... G03G 15/2042 399/69
2014/0023389 A1* 1/2014 Ono ..... G03G 15/2017 399/69
2014/0112680 A1* 4/2014 Ueno ..... G03G 15/2017 399/92
2014/0199090 A1* 7/2014 Kikushima ..... G03G 15/206 399/69
2017/0168432 A1* 6/2017 Kikushima ..... G03G 21/206

FOREIGN PATENT DOCUMENTS

JP H10142995 5/1998

* cited by examiner

*Primary Examiner* — Robert B Beatty
(74) *Attorney, Agent, or Firm* — JCIPRNET

(57) ABSTRACT

A fixing device includes a first roller that is arranged in a region where an image formed on a recording medium is fixed to the recording medium and that heats the recording medium, a second roller that is arranged to face the first roller in the region and pressurizes the recording medium toward the first roller, a fan that sends air to the second roller, and a processor configured to control the fan, in which the second roller has a shape in which a diameter of an end portion in a longitudinal axis direction is larger than a diameter of a central portion in the longitudinal axis direction, the first roller and the second roller fix the image to the recording medium in the region, and the processor is configured to change a rotation speed of the fan between the central portion and the end portion of the second roller.

15 Claims, 3 Drawing Sheets

FIG. 4

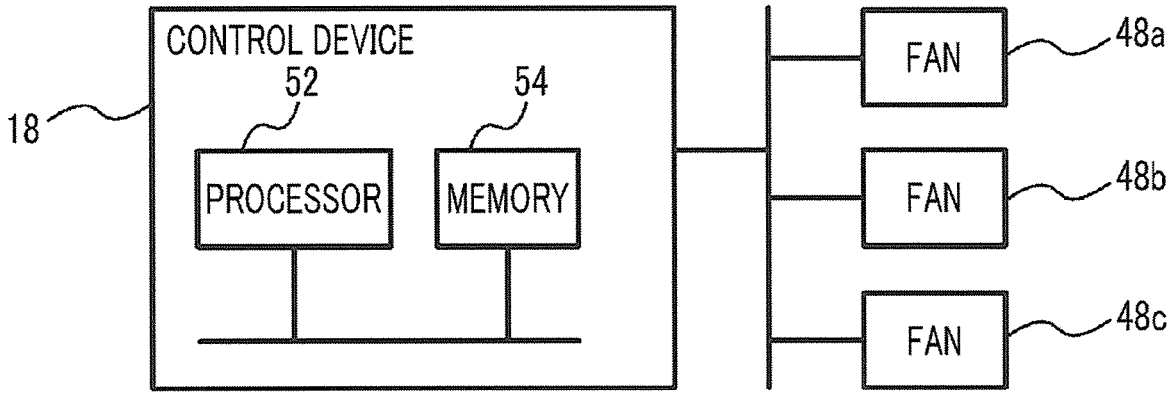

FIG. 5

| | | PRESSURIZING ROLLER TOTAL NIPPING TIME T | | |
|---|---|---|---|---|
| | | SHORT TIME (T < Ta) | MEDIUM (Ta ≤ T < Tb) | LONG TIME (Tb ≤ T) |
| STATE OF PRESSURIZING ROLLER | UNSTEADY | CENTRAL PORTION : XX − 5 [°C]<br>END PORTION : YY − 5 [°C] | CENTRAL PORTION : XX − 5 [°C]<br>END PORTION : YY [°C] | CENTRAL PORTION : XX − 5 [°C]<br>END PORTION : YY + 5 [°C] |
| | STEADY | CENTRAL PORTION : XX [°C]<br>END PORTION : YY − 5 [°C] | CENTRAL PORTION : XX [°C]<br>END PORTION : YY [°C] | CENTRAL PORTION : XX [°C]<br>END PORTION : YY + 5 [°C] |

FIXING DEVICE SUPPRESSING SHAPE CHANGE OF ROLLER

CROSS-REFERENCE TO RELATED APPLICATIONS

This application is based on and claims priority under 35 USC 119 from Japanese Patent Application No. 2021-197147 filed Dec. 3, 2021.

BACKGROUND

(i) Technical Field

The present invention relates to a fixing device.

(ii) Related Art

A fixing device that fixes an image formed on a recording medium such as paper to the recording medium is known. The fixing device includes a first roller and a second roller. The first roller and the second roller are arranged to face each other in a region where the image is fixed to the recording medium. The first roller heats the recording medium, and the second roller pressurizes the recording medium toward the first roller. The recording medium on which the image is formed passes through a space between the first roller and the second roller, and the fixing device fixes the image to the recording medium by applying heat and pressure to the recording medium.

JP1998-142995A describes a fixing device that corrects the magnitude of pressurization by a pressurizing roller based on a correction amount according to a cumulative value of the number of past fixing operations.

SUMMARY

However, in order to prevent wrinkles from being generated in the recording medium, the second roller has a flare shape in which the diameter of an end portion in a longitudinal axis direction is larger than the diameter of a center in the longitudinal axis direction in some cases. By using the second roller having the flare shape, the recording medium is transported while both ends of the recording medium are being pulled, and accordingly, the generation of wrinkles is prevented or suppressed. In a case where the shape of the second roller changes, a function of transporting the recording medium while pulling both ends of the recording medium decreases, and wrinkles are generated in the recording medium in some cases.

Aspects of non-limiting embodiments of the present disclosure relate to a fixing device that suppresses a change in the shape of a second roller compared to a case where a rotation speed of a fan which sends air to the second roller pressurizing a recording medium is maintained constant in the fixing device.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device including a first roller that is arranged in a region where an image formed on a recording medium is fixed to the recording medium and that heats the recording medium, a second roller that is arranged to face the first roller in the region and pressurizes the recording medium toward the first roller, a fan that sends air to the second roller, and a processor configured to control the fan, in which the second roller has a shape in which a diameter of an end portion in a longitudinal axis direction is larger than a diameter of a central portion in the longitudinal axis direction, the first roller and the second roller fix the image to the recording medium in the region, and the processor is configured to change a rotation speed of the fan between the central portion and the end portion of the second roller.

BRIEF DESCRIPTION OF THE DRAWINGS

Exemplary embodiment(s) of the present invention will be described in detail based on the following figures, wherein:

FIG. 4 is a block diagram showing a configuration related to control of the fan; and FIG. 5 is a view showing control of a temperature of the pressurizing roller.

DETAILED DESCRIPTION

Figure 1:
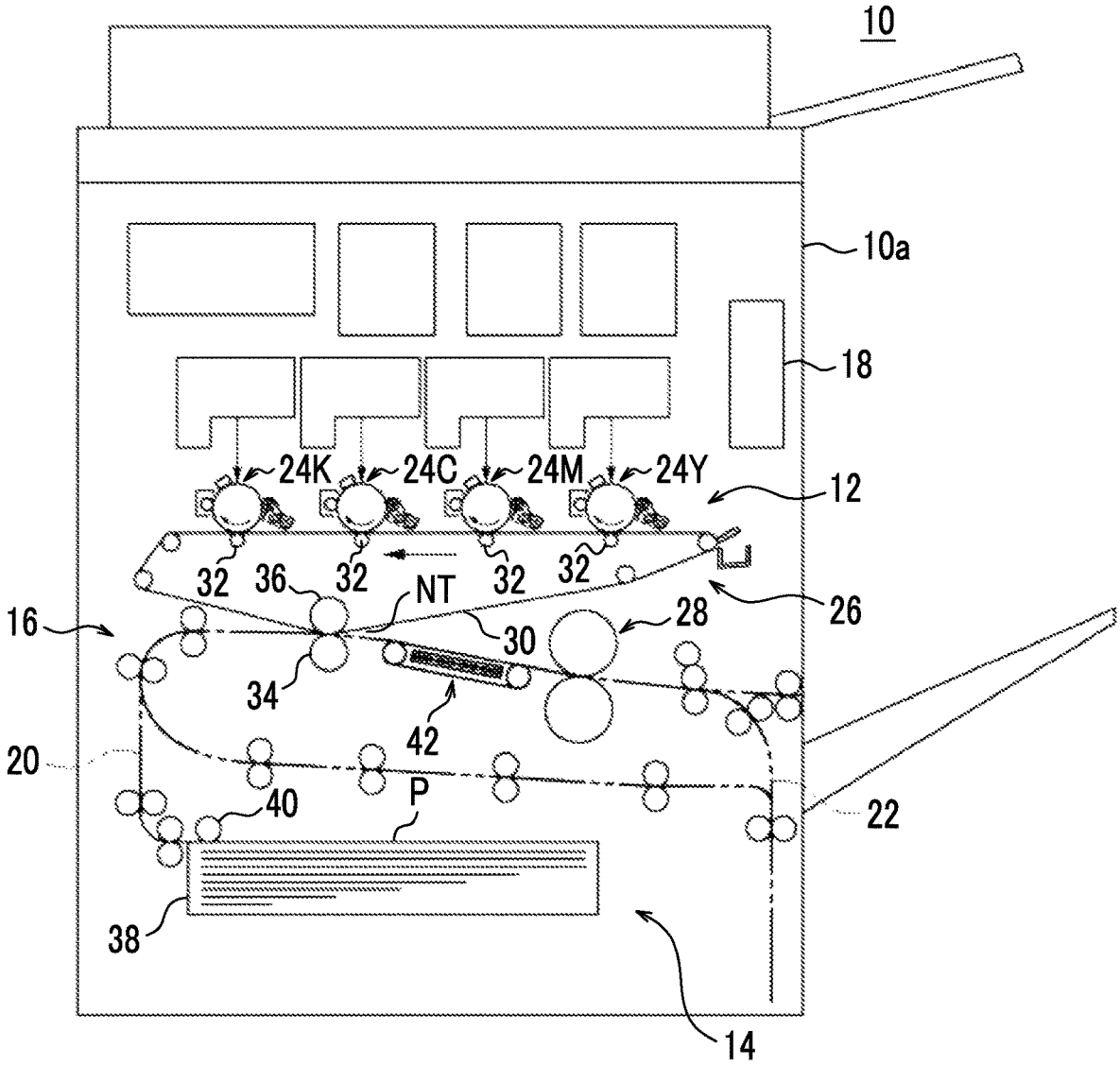
FIG. 1 is a view showing an outline of a configuration of an image forming apparatus according to an exemplary embodiment.

An image forming apparatus according to an exemplary embodiment will be described with reference to FIG. 1.

An image forming apparatus 10 according to the exemplary embodiment includes an image forming unit 12, an accommodating unit 14, a transport unit 16, and a control device 18.

The image forming unit 12 forms a toner image, for example, through an electrophotographic method. The accommodating unit 14 accommodates a recording medium P such as paper. The transport unit 16 transports the recording medium P accommodated in the accommodating unit 14 toward the image forming unit 12 along a transport path 20. In addition, the transport unit 16 transports the recording medium P transported along the transport path 20 along an inversion path 22 to invert the front and back of the recording medium P and again transports the recording medium toward the image forming unit 12.

The toner image formed by the image forming unit 12 is formed on the front surface of the recording medium P transported along the transport path 20. The recording medium P on which the toner image is formed is discharged to the outside of a housing 10*a* of the image forming apparatus 10.

In a case of forming a toner image on the back surface of the recording medium P, the recording medium P having the front surface on which the toner image is formed is transported along the inversion path 22, and the toner image is again formed on the back surface of the recording medium P by the image forming unit 12. After then, the recording medium P is discharged to the outside of the housing 10*a*. In the example shown in FIG. 1, the image forming apparatus 10 has a function of forming toner images on both surfaces of the recording medium P, but may have a function of forming a toner image only on one surface of the recording medium P.

The image forming unit 12 includes, for example, image forming units 24Y, 24M, 24C, and 24K, a transfer unit 26, and a fixing device 28 and forms a toner image for each color. The image forming unit 24Y forms a yellow (Y) toner image using a yellow (Y) toner. The image forming unit 24M forms a magenta (M) toner image using a magenta (M) toner. The image forming unit 24C forms a cyan (C) toner image using a cyan (C) toner. The image forming unit 24K forms a black (K) toner image using a black (K) toner. The transfer unit 26 transfers the toner image formed by each of the image forming units 24Y, 24M, 24C, and 24K to the recording medium P. The fixing device 28 fixes the toner image transferred to the recording medium P by the transfer unit 26 to the recording medium P. Although four colors of toners are used in the example shown in FIG. 1, this is merely an example, and five or more colors of toners may be used. For example, in addition to yellow, magenta, cyan, and black, other colors may be used. As another example, only a black toner may be used.

The image forming units 24Y, 24M, 24C, and 24K have basically the same configuration except for a toner to be used. For example, each of the image forming units 24Y, 24M, 24C, and 24K includes a rotating cylindrical image holding body, a charger that charges the image holding body, an exposure device, and a developing device. The exposure device irradiates the charged image holding body with light and forms an electrostatic latent image. The developing device develops the electrostatic latent image with a developer containing a toner as a toner image.

The transfer unit 26 includes a transfer belt 30, a primary transfer roller 32, a secondary transfer roller 34, and a roller 36. The transfer belt 30 is wound around a plurality of rollers including the roller 36 and moves around in a direction of an arrow in FIG. 1. A secondary transfer portion NT where the toner image is transferred to the recording medium P is formed between the secondary transfer roller 34 and the transfer belt 30.

The fixing device 28 is arranged on a downstream side of the secondary transfer portion NT in a transport direction of the recording medium P.

The accommodating unit 14 includes an accommodating member 38 and a feeding roller 40. The accommodating member 38 accommodates the recording medium P. The feeding roller 40 feeds the recording medium P accommodated in the accommodating member 38 to the transport path 20.

The transport unit 16 includes a plurality of transport rollers and a belt unit 42. The recording medium P fed from the accommodating unit 14 is transported along the transport path 20 by the plurality of transport rollers. The belt unit 42 transports the recording medium P to which the toner image is transferred and delivers the recording medium to the fixing device 28.

The control device 18 controls each unit of the image forming apparatus 10. Control by the control device 18 will be device in detail later.

The image forming apparatus 10 forms an image on the recording medium P as described below.

First, in each of the image forming units 24Y, 24M, 24C, and 24K, an electrostatic latent image is formed as the surface of the image holding body is charged by the charger and the surface of the image holding body is exposed by the exposure device, and the electrostatic latent image is developed by the developing device. Accordingly, a toner image is formed on the surface of the image holding body. A toner image having each color is transferred to the transfer belt 30 by the primary transfer roller 32 in turn.

The recording medium P is fed from the accommodating member 38 to the transport path 20 by the feeding roller 40 and is fed to the secondary transfer portion NT along the transport path 20. As the recording medium P is transported between the transfer belt 30 and the secondary transfer roller 34, the toner image transferred to the transfer belt 30 is transferred to the front surface of the recording medium P at the secondary transfer portion NT.

The toner image transferred to the front surface of the recording medium P is fixed to the recording medium P by the fixing device 28. The recording medium P to which the toner image is fixed is discharged to the outside of the housing 10*a*.

In a case of forming a toner image also on the back surface of the recording medium P, the transport unit 16 inverts the front and back of the recording medium P by transporting the recording medium P, which has passed through the fixing device 28, along the inversion path 22 and transports the recording medium P of which the front and back are inverted to the secondary transfer portion NT along the transport path 20. The toner image is transferred to the back surface of the recording medium P at the secondary transfer portion NT and the toner image is fixed to the recording medium P by the fixing device 28. The recording medium P to which the toner image is fixed is discharged to the outside from the housing 10*a*.

Figure 2:
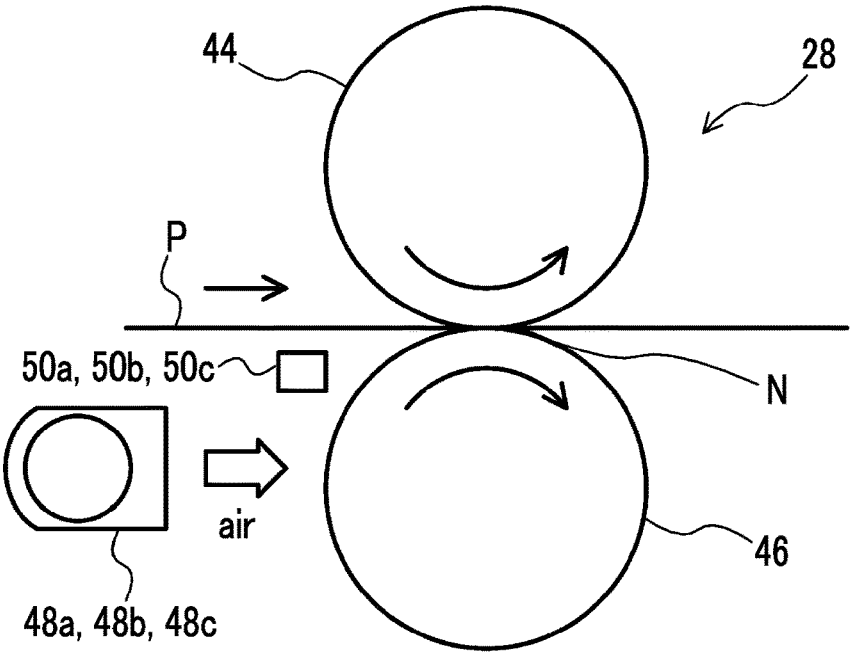
FIG. 2 is a view showing the outline of a configuration of a fixing device according to the exemplary embodiment.

The fixing device 28 will be described with reference to FIG. 2. FIG. 2 shows a configuration of the fixing device 28.

The fixing device 28 includes a fixing roller 44, a pressurizing roller 46, fans 48*a*, 48*b*, and 48*c*, and temperature sensors 50*a*, 50*b*, and 50*c*.

The fixing roller 44 and the pressurizing roller 46 are cylindrical rollers, and rotate about a rotation axis, which is an axis in a direction intersecting the transport direction of the recording medium P. The fixing roller 44 and the pressurizing roller 46 are arranged in a region where an image is transferred to the recording medium P.

The fixing roller 44 is rotated by a motor (not shown). A heater such as a halogen lamp is built in the fixing roller 44 and heats the recording medium P.

The pressurizing roller 46 is provided at a position facing the fixing roller 44 with a transport path of the recording medium P sandwiched therebetween and is rotated by a motor (not shown). The pressurizing roller 46 pressurizes the recording medium P. For example, the pressurizing roller 46 is pressed against the fixing roller 44 by an elastic member such as a spring, and accordingly, the recording medium P is pressurized toward the fixing roller 44. The pressurizing roller 46 may be rotated by the rotation of the fixing roller 44 without using the motor that rotates the pressurizing roller 46.

The pressurizing roller 46 includes, for example, a cylindrical member made of a metal such as aluminum, iron, and stainless steel, an elastic body layer that has heat resistance such as silicone rubber covering an outer circumference of the member, and a release layer made of a fluororesin covering an outer circumference of the elastic body layer.

A fixing portion N (that is, a Nip portion) where a toner image is fixed to the recording medium P is formed between the fixing roller 44 and the pressurizing roller 46. The recording medium P transported to the fixing portion N is heated by the fixing roller 44 and is pressurized toward the fixing roller 44 by the pressurizing roller 46. Accordingly, the toner image is fixed to the recording medium P. The fixing roller 44 is an example of a first roller, and the pressurizing roller 46 is an example of a second roller.

The fixing device 28 includes a cleaning roller (not shown). The cleaning roller removes a toner or foreign substances adhering to the surface of the fixing roller 44.

A fixing belt wound around the fixing roller 44 may be used, the fixing portion N may be formed between the fixing belt and the pressurizing roller 46, and the toner image may be fixed to the recording medium P.

The fans 48*a*, 48*b*, and 48*c* send cooling air ("air" in the drawings) to the pressurizing roller 46. The fans 48*a*, 48*b*, and 48*c* are not particularly limited insofar as the fans can send cooling air to the pressurizing roller 46. For example, a propeller fan, a blower, or a cross flow fan may be used.

In the example shown in FIG. 2, the fans 48*a*, 48*b*, and 48*c* are arranged on an upstream side of the fixing portion N in the transport path of the recording medium P and send cooling air from the upstream side to the pressurizing roller 46 (for example, a place where the fixing portion N is formed). This arrangement is merely an example. The fans 48*a*, 48*b*, and 48*c* may be arranged on the downstream side of the fixing portion N and send cooling air from the downstream side to the pressurizing roller 46 or may be arranged below the pressurizing roller 46 and send cooling air from below to the pressurizing roller 46.

The temperature sensors 50*a*, 50*b*, and 50*c* detect temperatures of the surface of the pressurizing roller 46. For example, the temperature sensors 50*a*, 50*b*, and 50*c* are sensors that detect temperatures in a non-contact manner, such as an infrared radiation temperature sensor.

In the example shown in FIG. 2, the temperature sensors 50*a*, 50*b*, and 50*c* are arranged on the upstream side of the fixing portion N in the transport path of the recording medium P and detect the temperatures of the surface of the pressurizing roller 46 near the fixing portion N. This arrangement is merely an example. The temperature sensors 50*a*, 50*b*, and 50*c* may be arranged on the downstream side of the fixing portion N and detect the temperatures of the surface of the pressurizing roller 46 or may be arranged below the pressurizing roller 46 and detect the temperatures of the surface of the pressurizing roller 46.

Figure 3:
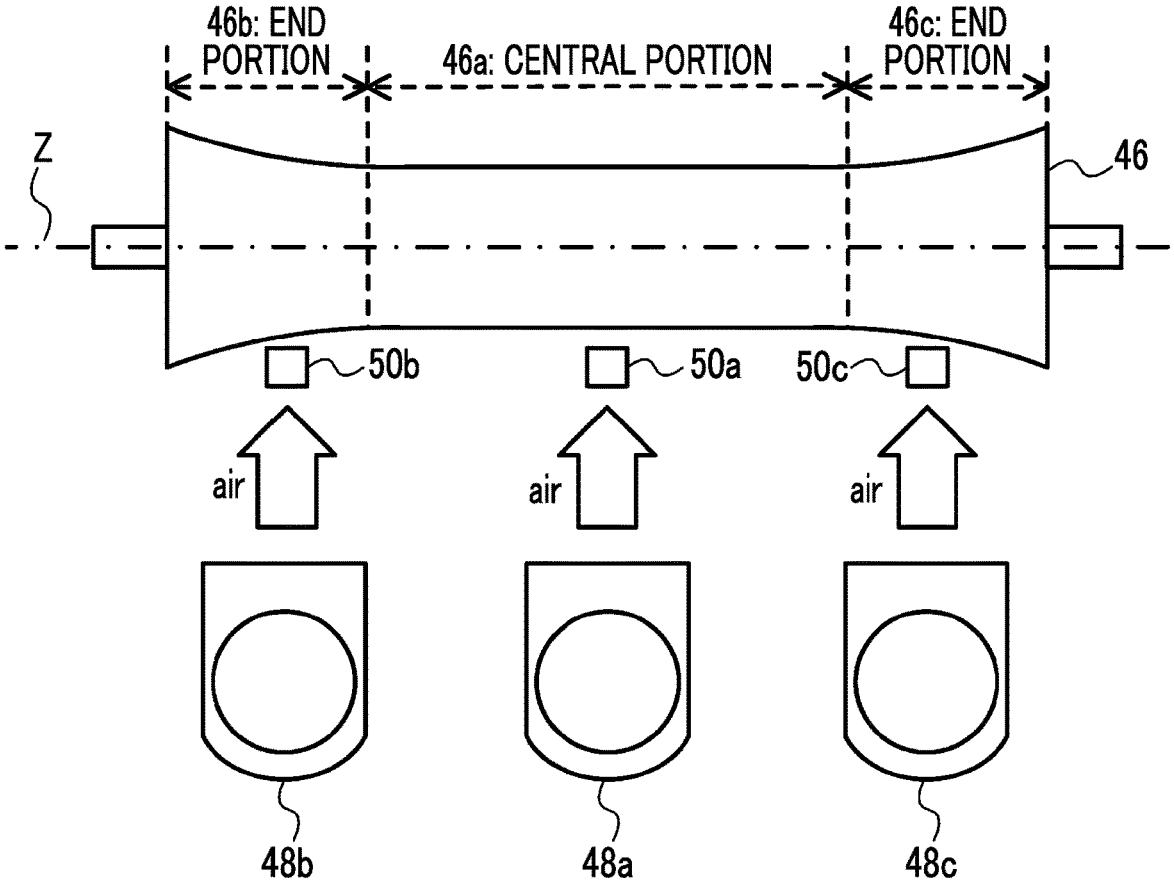
FIG. 3 is a view showing a pressurizing roller and a fan.

The shape of the pressurizing roller 46 and a positional relationship between the pressurizing roller 46 and the fans 48*a*, 48*b*, and 48*c* will be described with reference to FIG. 3. FIG. 3 is a view showing the pressurizing roller 46 and the fans 48*a*, 48*b*, and 48*c*.

A direction in which the cylindrical pressurizing roller 46 extends will be defined as a longitudinal axis direction Z of the pressurizing roller 46. The pressurizing roller 46 is generally configured by a central portion 46*a* and end portions 46*b* and 46*c* along the longitudinal axis direction Z. In addition, the pressurizing roller 46 has a shape (that is, flare shape) in which the diameters of the end portions 46*b* and 46*c* in the longitudinal axis direction Z are larger than the diameter of the central portion 46*a* in the longitudinal axis direction Z. That is, the end portions 46*b* and 46*c* have a shape that extends outward from the central portion 46*a*.

For example, the central portion 46*a* is a portion between the end portion 46*b* and the end portion 46*c*, is a portion having a constant diameter along the longitudinal axis direction Z, or is a portion having an almost constant diameter to a degree that an effect on pressurization is negligible. The end portions 46*b* and 46*c* each are a portion having a diameter that increases as separating away from the central portion 46*a* along the longitudinal axis direction Z.

By using the pressurizing roller 46 having a flare shape, a force that pulls the recording medium P to both outer sides acts on the recording medium P, and as a result, the generation of paper wrinkles is suppressed. For example, even in a case where thin paper (for example, paper having gms of 70 or less and 80 or more) is used as the recording medium P, the generation of paper wrinkles is suppressed. It is evident that the generation of paper wrinkles is suppressed also in a case where paper other than the thin paper is used.

The fan 48*a* is arranged at a position corresponding to the central portion 46*a* and sends cooling air to the central portion 46*a*. The fan 48*b* is arranged at a position corresponding to the end portion 46*b* and sends cooling air to the end portion 46*b*. The fan 48*c* is arranged at a position corresponding to the end portion 46*c* and sends cooling air to the end portion 46*c*.

The temperature sensor 50*a* is arranged at a position corresponding to the central portion 46*a* and detects the temperature of the surface of the central portion 46*a*. The temperature sensor 50*b* is arranged at a position corresponding to the end portion 46*b* and detects the temperature of the surface of the end portion 46*b*. The temperature sensor 50*c* is arranged at a position corresponding to the end portion 46*c* and detects the temperature of the surface of the end portion 46*c*. Data of the temperature detected by each of the temperature sensors 50*a*, 50*b*, and 50*c* is output to the control device 18.

A configuration related to control of the fans 48*a*, 48*b*, and 48*c* will be described with reference to FIG. 4. FIG. 4 is a block diagram showing the configuration.

For example, the control device 18 includes a processor 52 and a memory 54. Although the control device 18 controls an operation of each unit of the image forming apparatus 10, the configuration related to the control of the fans 48*a*, 48*b*, and 48*c* is shown in FIG. 4.

The processor 52 controls an operation of each of the fans 48*a*, 48*b*, and 48*c*. For example, by controlling a rotation speed of each of the fans 48*a*, 48*b*, and 48*c*, the processor 52 controls the volume of air of each fan.

The memory 54 is a device that configures one or a plurality of storage areas which store data. The memory 54 is, for example, a hard disk drive (HDD), a solid state drive (SSD), various types of memories (for example, RAM, DRAM, or ROM), other storage devices (for example, an optical disk), or a combination thereof. One or a plurality of memories 54 are included in the control device 18. The memory 54 may be provided at a place other than the control device 18 in the image forming apparatus 10 without being included in the control device 18.

Hereinafter, the control of the fans 48*a*, 48*b*, and 48*c* will be described.

The processor 52 controls the volume of air of each of the fans 48*a*, 48*b*, and 48*c* by controlling the rotation speed of each of the fans 48*a*, 48*b*, and 48*c* and accordingly, controls the temperature of the central portion 46*a* of the pressurizing roller 46 and the temperatures of the end portions 46*b* and 46*c*.

For example, the processor 52 changes the rotation speed of the fan between the central portion 46*a* and the end portions 46*b* and 46*c* of the pressurizing roller 46. Specifically, the processor 52 makes the rotation speed of the fan 48*a* that sends cooling air to the central portion 46*a* different from the rotation speed of each of the fans 48*b* and 48*c* that send cooling air to the end portions 46*b* and 46*c*. Accordingly, the volume of air of the fan 48*a* and the volume of air of each of the fans 48*b* and 48*c* become different from each other, and as a result, the control of the temperature of the central portion 46*a* and the control of the temperature of each of the end portions 46*b* and 46*c* become different from each other.

In a case where cooling air is sent to the pressurizing roller 46 from the fan, the temperature of the pressurizing roller 46 decreases. However, in a case where the rotation speed of the fan is small, a decrease in the temperature of the pressurizing roller 46 is suppressed since the volume of cooling air sent to the pressurizing roller 46 decreases, compared to a case where the rotation speed of the fan is large. Thermal expansion of the pressurizing roller 46 is controlled by controlling the temperature based on the control of the volume of air. For example, the thermal expansion of the pressurizing roller 46 is controlled such that the flare shape of the pressurizing roller 46 is maintained. Specifically, the rotation speed of each of the fans 48*a*, 48*b*, and 48*c* is controlled such that thermal expansion in which the flare shape of the pressurizing roller 46 is maintained is realized.

For example, the processor 52 changes the rotation speed of each of the fans 48*a*, 48*b*, and 48*c* according to the length of a total time during which the pressurizing roller 46 pressurizes the recording medium P (hereinafter, referred to as a "total nipping time"). That is, the processor 52 controls the temperature of each of the central portion 46*a* and the end portions 46*b* and 46*c* by changing the volume of air of each of the fans 48*a*, 48*b*, and 48*c* according to the total nipping time. The total nipping time corresponds to the length of a total time during which the pressurizing roller 46 is used in fixing in the fixing device 28 and corresponds to a change in the shape of the pressurizing roller 46 over time. In general, as the total nipping time increases, that is, as a time for which the pressurizing roller 46 is used in fixing increases, a change in the shape of the pressurizing roller 46 over time increases. Specifically, as the total nipping time increases, the diameters of the end portions 46*b* and 46*c* decrease, the flare shape becomes difficult to be maintained.

As another example, the processor 52 changes the rotation speed of each of the fans 48*a*, 48*b*, and 48*c* according to the state of the pressurizing roller 46 (for example, the state of the temperature of the pressurizing roller 46). That is, the temperature of each of the central portion 46*a* and the end portions 46*b* and 46*c* is controlled by changing the volume of air of each of the fans 48*a*, 48*b*, and 48*c* according to the state of the pressurizing roller 46.

Hereinafter, the control of the fans 48*a*, 48*b*, and 48*c*, that is, the control of the temperature of the pressurizing roller 46 will be described with reference to FIG. 5. FIG. 5 shows the control of the temperature of the pressurizing roller 46. Specifically, control of the temperature according to a total nipping time T and control of the temperature according to the state of the pressurizing roller 46 are shown.

FIG. 5 shows an "unsteady" state and a "steady" state as the state of the pressurizing roller 46.

The "steady" state is, for example, a state where a time Ts determined in advance or more has elapsed from a time point when a power supply of the image forming apparatus 10 is turned on or a state where an image is formed on the number Ns of sheets or more of the recording media P, which is determined in advance, after the power supply of the image forming apparatus 10 is turned on. The time Ts is a time required for the temperature of the pressurizing roller 46 to become a temperature determined in advance or more or a time required for the temperature of the pressurizing roller 46 to become stable after the pressurizing roller 46 starts to be heated by turning on the power supply of the image forming apparatus 10. The number Ns is a value corresponding to the time Ts.

The "unsteady" state is a state that does not reach the "steady" state. That is, the "unsteady" state is a state where the time Ts or more has not elapsed from the time point when the power supply of the image forming apparatus 10 is turned on (that is, a state of less than the time Ts) or a state where an image is not formed on the number Ns of sheets or more of the recording media P after the power supply of the image forming apparatus 10 is turned on. In general, in the "unsteady" state, the pressurizing roller 46 is not as heated as in the "steady" state. Thus, the temperature of the pressurizing roller 46 is low compared to the "steady" state.

First, the control of the temperature according to the total nipping time T, that is, the control of the temperature according to a change in the shape of the pressurizing roller 46 over time will be described. The processor 52 controls the temperature of each of the central portion 46*a* and the end portions 46*b* and 46*c* by changing the rotation speed of each of the fans 48*a*, 48*b*, and 48*c* according to the length of the total nipping time T.

In the example shown in FIG. 5, the total nipping time T is divided into, for example, "short time", "medium", and "long time". Times Ta and Tb are thresholds for the total nipping time, and a relationship of the time Tb>the time Ta is satisfied. The classification of the total nipping time shown in FIG. 5 is merely an example, and the fans 48*a*, 48*b*, and 48*c* may be controlled by classifying the total nipping time in further detail.

In a case where the total nipping time T is less than the time Ta, the total nipping time T corresponds to the "short time". In a case where the total nipping time T is the time Ta or more and less than the time Tb, the total nipping time T corresponds to the "medium" time. In a case where the total nipping time T is the time Tb or more, the total nipping time T corresponds to the "long time". The "short time" corresponds to a small change in the shape of the pressurizing roller 46 over time. The "medium" time corresponds to a medium change in the shape of the pressurizing roller 46 over time. The "long time" corresponds to a large change in the shape of the pressurizing roller 46 over time.

The processor 52 measures a time for which the pressurizing roller 46 pressurizes the recording medium P in each session of fixing and measures the total nipping time T from a time when the pressurizing roller 46 is mounted on the image forming apparatus 10. The total nipping time T is stored in the memory 54.

For example, the processor 52 controls the rotation speed of each of the fans 48*b* and 48*c* by increasing the temperature of each of the end portions 46*b* and 46*c* as the total nipping time T increases. In addition, the processor 52 controls the rotation speed of the fan 48*a* such that the temperature of the central portion 46*a* is constant regardless of the total nipping time.

In general, as the total nipping time T increases, a change in the shape of the pressurizing roller 46 over time increases. That is, the diameter of each of the end portions 46*b* and 46*c* decreases, the flare shape of the pressurizing roller 46 is difficult to be maintained. In such as case, by controlling the rotation speed of each of the fans 48*b* and 48*c* such that the temperature of each of the end portions 46*b* and 46*c* is high, an increase in the diameter of each of the end portions 46*b* and 46*c* caused by the thermal expansion of the end portions 46*b* and 46*c* or a decrease in the diameter of each of the end portions 46*b* and 46*c* is suppressed. As a result, the flare shape of the pressurizing roller 46 is maintained.

To focus on the "unsteady" state, the processor 52 controls the rotation speed of each of the fans 48*b* and 48*c* such that the temperature of each of the end portions 46*b* and 46*c* is "YY−5 [° C.]" in a case where the total nipping time T is the "short time", is "YY [° C.]" in a case where the total nipping time T is "medium", and is "YY+5 [° C.]", in a case where the total nipping time T is the "long time". In addition, regardless of the length of the total nipping time, the processor 52 controls the rotation speed of the fan 48*a* such that the temperature of the central portion 46*a* is maintained at "XX−5 [° C.]". The temperature "YY [° C.]" and the temperature "XX [° C.]" are temperatures determined in advance.

Data of the temperature detected by each of the temperature sensors 50*a*, 50*b*, and 50*c* is output to the processor 52, and the processor 52 controls the rotation speed of each of the fans 48*a*, 48*b*, and 48*c* based on the temperature detected by each of the temperature sensors 50*a*, 50*b*, and 50*c*.

For example, the processor 52 increases the temperature of each of the end portions 46*b* and 46*c* as the total nipping time T increases by decreasing the rotation speed of each of the fans 48*b* and 48*c* as the total nipping time T increases. To describe specifically, the processor 52 decreases the rotation speed of each of the fans 48*b* and 48*c* with respect to each of the end portions 46*b* and 46*c* in a second total nipping time T2 longer than a first total nipping time T1, compared to the rotation speed each of the fans 48*b* and 48*c* with respect to each of the end portions 46*b* and 46*c* in the first total nipping time T1. The first total nipping time is an example of a first total time, and the second total nipping time is an example of a second total time. Hereinafter, this control will be described in further detail.

In a case where the first total nipping time T1 is the "short time" and the second total nipping time is the "medium" time, the processor 52 controls the rotation speed of each of the fans 48*b* and 48*c* such that the temperature of each of the end portions 46*b* and 46*c* in the "medium" time is higher than the temperature of each of the end portions 46*b* and 46*c* in the "short time". Specifically, the processor 52 decreases the rotation speed of each of the fans 48*b* and 48*c* in the "medium" time compared to the rotation speed of each of the fans 48*b* and 48*c* in the "short time". By decreasing the rotation speed of each of the fans 48*b* and 48*c*, the volume of air with respect to each of the end portions 46*b* and 46*c* decreases. Thus, the temperature of each of the end portions 46*b* and 46*c* is difficult to be decreased compared to a case where the rotation speed of each of the fans 48*b* and 48*c* is large. As a result, the temperature of each of the end portions 46*b* and 46*c* in the "medium" time is higher than the temperature of each of the end portions 46*b* and 46*c* in the "short time". In the example shown in FIG. 5, the temperature of each of the end portions 46*b* and 46*c* in the "medium" time is "+5 [° C.]", higher than the temperature of each of the end portions 46*b* and 46*c* in the "short time".

In general, a change in the shape of each of the end portions 46*b* and 46*c* over time in the "medium" time is larger than a change in the shape over time in the "short time". That is, the diameter of each of the end portions 46*b* and 46*c* in the "medium" time is smaller than the diameter of each of the end portions 46*b* and 46*c* in the "short time". Therefore, it is more difficult to maintain the flare shape of the pressurizing roller 46 in the "medium" time than in the "short time". Thus, by making the temperature of each of the end portions 46*b* and 46*c* in the "medium" time higher than the temperature of each of the end portions 46*b* and 46*c* in the "short time", an increase in the diameter of each of the end portions 46*b* and 46*c* caused by the thermal expansion of the end portions 46*b* and 46*c* or a decrease in the diameter of each of the end portions 46*b* and 46*c* is suppressed in the "medium" time. As a result, the flare shape of the pressurizing roller 46 is maintained.

Also in a case where the first total nipping time T1 is the "medium" time and the second total nipping time is the "long time", the processor 52 controls the rotation speed of each of the fans 48*b* and 48*c* such that the temperature of each of the end portions 46*b* and 46*c* in the "long time" is higher than the temperature of each of the end portions 46*b* and 46*c* in the "medium" time. In the example shown in FIG. 5, the temperature of each of the end portions 46*b* and 46*c* in the "long time" is "+5 [° C.]", higher than the temperature of each of the end portions 46*b* and 46*c* in the "medium" time. Accordingly, an increase in the diameter of each of the end portions 46*b* and 46*c* caused by the thermal expansion of the end portions 46*b* and 46*c* or a decrease in the diameter of each of the end portions 46*b* and 46*c* is suppressed in the "long time". As a result, the flare shape of the pressurizing roller 46 is maintained.

In addition, the processor 52 controls the rotation speed of the fan 48*a* such that the temperature of the central portion 46*a* is maintained constant in each of the "short time", the "medium" time, and the "long time". For example, the processor 52 does not change the rotation speed of the fan 48*a*. Accordingly, as the total nipping time increases, the temperature of each of the end portions 46*b* and 46*c* increases while the temperature of the central portion 46*a* is maintained constant. As a result, a difference between the temperature of the central portion 46*a* and the temperature of each of the end portions 46*b* and 46*c* increases. The flare shape of the pressurizing roller 46 is maintained also by the temperature difference, that is, a temperature distribution in the pressurizing roller 46. That is, by expanding each of the end portions 46*b* and 46*c* as the temperature of each of the end portions 46*b* and 46*c* increases while the temperature of the central portion 46*a* is maintained constant, a shape in which the diameter of the end portions 46*b* and 46*c* is larger than the diameter of the central portion 46*a* is maintained.

Accordingly, the temperature of the central portion 46*a* may not be maintained constant insofar as the difference between the temperature of the central portion 46*a* and the temperature of each of the end portions 46*b* and 46*c* increases while the temperature of each of the end portions 46*b* and 46*c* increases as the total nipping time increases. That is, the rotation speed of the fan 48*a* may not be maintained constant. The temperature of the central portion 46*a* does not necessarily have to be maintained constant since the flare shape is maintained insofar as the difference between the temperature of the central portion 46*a* and the temperature of each of the end portions 46*b* and 46*c* increases as the total nipping time increases.

Also in the "steady" state, the rotation speed of each of the fans 48*a*, 48*b*, and 48*c* is controlled according to the total nipping time as in the "unsteady" state.

Next, control of the temperature according to the state of the pressurizing roller 46 will be described. Herein, for example, the state of the pressurizing roller 46 is the state of the temperature of the pressurizing roller 46. The processor 52 controls the temperature of each of the central portion 46*a* and the end portions 46*b* and 46*c* by changing the rotation speed of each of the fans 48*a*, 48*b*, and 48*c* according to the state of the temperature of the pressurizing roller 46. The state of the temperature of the pressurizing roller 46 is the "unsteady" state or the "steady" state, and the processor 52 changes the rotation speed of each of the fans 48*a*, 48*b*, and 48*c* according to whether the state of the pressurizing roller 46 is the "unsteady" state or the "steady" state.

In general, in the "unsteady" state, the pressurizing roller 46 is not as heated as in the "steady" state. Thus, the temperature of the pressurizing roller 46 is low compared to the "steady" state. In the example shown in FIG. 5, the temperature of the central portion 46*a* in the "unsteady" state is lower than the temperature of the central portion 46*a* in the "steady" state. Also in this case, the rotation speed of each of the fans 48*b* and 48*c* is controlled such that the flare shape of each of the end portions 46*b* and 46*c* is maintained. Hereinafter, specific control will be described.

The processor 52 controls the rotation speed of each of the fans 48*b* and 48*c* such that the temperature of each of the end portions 46*b* and 46*c* in the "unsteady" state becomes the same as the temperature of each of the end portions 46*b* and 46*c* in the "steady" state. For example, since the temperature of the pressurizing roller 46 in the "unsteady" state is not as high as in the "steady" state, it is assumed that each of the end portions 46*b* and 46*c* is excessively cooled in the "unsteady" state in a case where the rotation speed of each of the fans 48*b* and 48*c* is the same in the "unsteady" state and the "steady" state. Therefore, the processor 52 decreases the rotation speed of each of the fans 48*b* and 48*c* in the "unsteady" state compared to the rotation speed of each of the fans 48*b* and 48*c* in the "steady" state. Accordingly, also in the "unsteady" state in which the pressurizing roller 46 is not as heated as in the "steady" state, the flare shape of each of the end portions 46*b* and 46*c* is maintained.

To focus on the "short time" in the example shown in FIG. 5, the processor 52 controls the rotation speed of each of the fans 48*b* and 48*c* such that the temperature of each of the end portions 46*b* and 46*c* becomes "YY−5 [° C.]" in each of the "unsteady" state and the "steady" state. Also in the "medium" time and the "long time", the processor 52 controls the rotation speed of each of the fans 48*b* and 48*c* as in the control in the "short time".

Even in a case where the temperature of each of the end portions 46*b* and 46*c* in the "unsteady" state and the temperature of each of the end portions 46*b* and 46*c* in the "steady" state are not the same, the processor 52 may control the rotation speed of each of the fans 48*b* and 48*c* such that a difference between the temperature of each of the end portions 46*b* and 46*c* in the "unsteady" state and the temperature of each of the end portions 46*b* and 46*c* in the "steady" state is included in an allowable range. The allowable range is determined as a range in which a flare shape necessary for suppressing the generation of wrinkles is formed.

The processor 52 may change the rotation speed of the fan between the central portion 46*a* and each of the end portions 46*b* and 46*c* according to the state of the temperature of the pressurizing roller 46. That is, the processor 52 may make a change in the rotation speed of the fan 48*a* and a change in the rotation speed of each of the fans 48*b* and 48*c* different from each other according to the state of the temperature of the pressurizing roller 46. To describe the example shown in FIG. 5, the processor 52 makes the change in the rotation speed of the fan 48*a* and the change in the rotation speed of each of the fans 48*b* and 48*c* different from each other in a case where the state of the pressurizing roller 46 transitions from the "unsteady" state to the "steady" state.

For example, in a case of transitioning from the "unsteady" state to the "steady" state, the processor 52 controls the rotation speed of the fan 48*a* such that the temperature of the central portion 46*a* rises and controls the rotation speed of each of the fans 48*b* and 48*c* such that the temperature of each of the end portions 46*b* and 46*c* is maintained constant.

To describe the example shown in FIG. 5, the processor 52 controls the rotation speed of the fan 48*a* (for example, decreases the rotation speed) such that the temperature of the central portion 46*a* rises from "XX−5 [° C.]" to "XX [° C.]". In addition, to focus on the "short time", the processor 52 controls the rotation speed of each of the fans 48*b* and 48*c* such that the temperature of each of the end portions 46*b* and 46*c* is maintained at "YY−5 [° C.]". The same applies also in the "medium" time and the "long time". By performing such control, the flare shape of the pressurizing roller 46 is maintained also in a case where the state of the pressurizing roller 46 has transitioned from the "unsteady" state to the "steady" state.

The processor 52 may control the rotation speed of each of the fans 48*b* and 48*c* such that the difference between the temperature of each of the end portions 46*b* and 46*c* in the "unsteady" and the temperature of each of the end portions 46*b* and 46*c* in the "steady" state is included in the allowable range.

In addition, in a case where the temperature of the central portion 46*a* rises in the "unsteady" state in which the temperature of each of the end portions 46*b* and 46*c* does not rise, there is a probability that the diameter of the central portion 46*a* increases due to the thermal expansion of the central portion 46*a* and the flare shape of the pressurizing roller 46 is not maintained. Therefore, the flare shape of the pressurizing roller 46 is maintained by no raising the temperature of the central portion 46*a* in the "unsteady" state as much as in the "steady" state.

Hereinafter, a modification example will be described.

In the modification example, the processor 52 controls the rotation speed of each of the fans 48*a*, 48*b*, and 48*c* such that the difference between the temperature of the central portion 46*a* and the temperature of each of the end portions 46*b* and 46*c* of the pressurizing roller 46 is small in a case where the quality of an image (that is, image quality) formed on the recording medium P is prioritized, compared to a case where the image quality is not prioritized. Depending on the size of the difference between the temperature of the central portion 46*a* and the temperature of each of the end portions 46*b* and 46*c*, there is a difference in how a toner melts between a central portion and an end portion of the recording medium P, there is a difference in glossiness between the central portion and the end portion (that is, a gloss difference increases), and the image quality deteriorates. In a case of prioritizing the image quality, the processor 52 controls the rotation speed of each of the fans 48*a*, 48*b*, and 48*c* such that the gloss difference decreases. For example, the processor 52 controls the rotation speed of each of the fans 48*a*, 48*b*, and 48*c* such that the difference between the temperature of the central portion 46*a* and the temperature of each of the end portions 46*b* and 46*c* is a threshold or less. The threshold is a value at which the gloss difference is in the allowable range. By performing such control, a difference in glossiness between the central portion and the end portion of the recording medium P decreases, and deterioration of the image quality is suppressed. Prioritizing the image quality may be designated by a user or may be determined in advance through a print job.

The function of the control device 18 is realized, for example, in cooperation with hardware and software. For example, the function of the control device 18 is realized as the processor 52 of the control device 18 reads and executes a program stored in the memory 54. The program is stored in the memory 54 via a recording medium such as a CD and a DVD or via a communication path such as a network.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device). In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first roller that is arranged in a region where an image formed on a recording medium is fixed to the recording medium and that heats the recording medium;

a second roller that is arranged to face the first roller in the region and pressurizes the recording medium toward the first roller;

a fan that sends air to the second roller; and a processor configured to control the fan, wherein the second roller has a shape in which a diameter of an end portion in a longitudinal axis direction is larger than a diameter of a central portion in the longitudinal axis direction, the first roller and the second roller fix the image to the recording medium in the region, and the processor is configured to change a rotation speed of the fan between the central portion and the end portion of the second roller according to a length of a total time for which the second roller pressurizes the recording medium.

2. The fixing device according to claim 1, wherein the processor is configured to:

decrease the rotation speed of the fan with respect to the end portion of the second roller in a second total time longer than a first total time compared to the rotation speed of the fan with respect to the end portion of the second roller in the first total time.

3. The fixing device according to claim 2, wherein the processor is configured to:

change the rotation speed of the fan with respect to the end portion of the second roller between the first total time and the second total time without changing the rotation speed of the fan with respect to the central portion of the second roller between the first total time and the second total time.

4. The fixing device according to claim 1, wherein the processor is configured to:

change the rotation speed of the fan according to a state of a temperature of the second roller.

5. The fixing device according to claim 2, wherein the processor is configured to:

change the rotation speed of the fan according to a state of a temperature of the second roller.

6. The fixing device according to claim 3, wherein the processor is configured to:

change the rotation speed of the fan according to a state of a temperature of the second roller.

7. The fixing device according to claim 4, wherein the processor is configured to:

change the rotation speed of the fan between the central portion and the end portion of the second roller according to the state of the temperature of the second roller.

8. The fixing device according to claim 5, wherein the processor is configured to:

change the rotation speed of the fan between the central portion and the end portion of the second roller according to the state of the temperature of the second roller.

9. The fixing device according to claim 6, wherein the processor is configured to:

change the rotation speed of the fan between the central portion and the end portion of the second roller according to the state of the temperature of the second roller.

10. The fixing device according to claim 1, wherein the processor is configured to:

control the rotation speed of the fan such that a difference between temperatures of the central portion and the end portion of the second roller decreases in a case of prioritizing an image quality, compared to a case of not prioritizing the image quality.

11. The fixing device according to claim 2, wherein the processor is configured to:

control the rotation speed of the fan such that a difference between temperatures of the central portion and the end portion of the second roller decreases in a case of prioritizing an image quality, compared to a case of not prioritizing the image quality.

12. The fixing device according to claim 3, wherein the processor is configured to:

control the rotation speed of the fan such that a difference between temperatures of the central portion and the end portion of the second roller decreases in a case of prioritizing an image quality, compared to a case of not prioritizing the image quality.

13. The fixing device according to claim 4, wherein the processor is configured to:

control the rotation speed of the fan such that a difference between temperatures of the central portion and the end portion of the second roller decreases in a case of prioritizing an image quality, compared to a case of not prioritizing the image quality.

14. The fixing device according to claim 5, wherein the processor is configured to:

control the rotation speed of the fan such that a difference between temperatures of the central portion and the end portion of the second roller decreases in a case of prioritizing an image quality, compared to a case of not prioritizing the image quality.

15. The fixing device according to claim 6, wherein the processor is configured to:

control the rotation speed of the fan such that a difference between temperatures of the central portion and the end portion of the second roller decreases in a case of prioritizing an image quality, compared to a case of not prioritizing the image quality.

* * * * *